US009351075B2

(12) United States Patent
Kunimoto

(10) Patent No.: US 9,351,075 B2
(45) Date of Patent: May 24, 2016

(54) BODY-SENSITIVE VIBRATION HEADPHONE

(71) Applicant: Panasonic Intellectual Property Management Co., Ltd., Osaka (JP)

(72) Inventor: Hiroshi Kunimoto, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 14/602,289

(22) Filed: Jan. 22, 2015

(65) Prior Publication Data

US 2015/0146893 A1 May 28, 2015

Related U.S. Application Data

(63) Continuation of application No. PCT/JP2014/003338, filed on Jun. 23, 2014.

(30) Foreign Application Priority Data

Nov. 27, 2013 (JP) ..... 2013-244520

(51) Int. Cl.
*H04R 25/00* (2006.01)
*H04R 5/033* (2006.01)

(52) U.S. Cl.
CPC ..... *H04R 5/033* (2013.01); *H04R 2400/03* (2013.01); *H04R 2460/13* (2013.01)

(58) Field of Classification Search
CPC .. H04R 1/1008; H04R 1/1075; H04R 1/1091; H04R 2460/13
USPC ..... 381/151, 380, 370, 371, 345, 353, 354, 381/376
See application file for complete search history.

(56) References Cited

U.S. PATENT DOCUMENTS

2009/0252352 A1* 10/2009 Emilsson ..... H04R 1/46 381/151

FOREIGN PATENT DOCUMENTS

| | | |
|---|---|---|
| JP | 59-098121 | 6/1984 |
| JP | 5-008209 B | 2/1993 |
| JP | 7-203575 | 8/1995 |
| JP | 2003-032768 | 1/2003 |
| JP | 2006-197257 | 7/2006 |
| JP | 2007-019957 | 1/2007 |

OTHER PUBLICATIONS

International Search Report of PCT application No. PCT/JP2014/003338 dated Aug. 19, 2014.

* cited by examiner

*Primary Examiner* — Sunita Joshi
(74) *Attorney, Agent, or Firm* — McDermott Will & Emery LLP

(57) ABSTRACT

There is provided a body-sensitive vibration headphone for suppressing resonance that occurs when a vibrator that generates body-sensitive vibration vibrates. The body-sensitive vibration headphone includes electroacoustic transducer (50) that converts an input signal into an acoustic wave, housing (20) that accommodates electroacoustic transducer (50), vibrator (31) that converts the input signal into vibration, and ear pad (40) attached to housing (20). Vibrator (31) is attached to ear pad (40), and a structure between vibrator (31) and ear pad (40) is formed such that conduction of the vibration from the vibrator (31) is impeded.

4 Claims, 6 Drawing Sheets

BODY-SENSITIVE VIBRATION HEADPHONE

TECHNICAL FIELD

The present disclosure relates to a body-sensitive vibration headphone for suppressing resonance that is generated by vibration of a vibrator that generates body-sensitive vibration.

BACKGROUND ART

In recent years, a hybrid bone conduction headphone (also referred to as a body-sensitive vibration headphone) having a bone conduction vibration unit mounted in a speaker unit and reproducing a range from a heavy bass sound to middle and high registers have been available in the market. The mounted bone conduction vibration unit compensates a heavy low register that is insufficient in a speaker unit for reproducing middle and high registers. This makes it possible to enjoy a game or a movie with an impressive sound.

On the other hand, a body-sensitive vibration headphone having the bone conduction vibration unit mounted to compensate the high register is disclosed in, for example, PTL 1. PTL 1 discloses a closed type headphone for providing a stimulus to a brain by bone conduction, the closed type headphone having a vibration frequency of 10 kHz or higher and a vibrator attached to an ear pad. In this headphone, vibration from the vibrator directly stimulates a brain and an auditory nerve by bone conduction without passing through an eardrum.

CITATION LIST

Patent Literature

PTL 1: Unexamined Japanese Patent Publication No. 2003-32768

SUMMARY

PTL 1 has a configuration that conveys vibration of 10 kHz or higher to a brain by bone conduction to allow a bodily sensation of a high register to be felt with body parts other than an eardrum. This structure however has a problem that the vibration of a vibrator travels also to a housing through an ear pad, vibration resonance occurs in the housing, a sound from an electroacoustic transducer and a sound generated by vibration resonance are mixed with each other, and a sound is heard with distortion.

An object of the present disclosure is to provide a body-sensitive vibration headphone having a structure for suppressing resonance that is generated by vibration of a vibrator that generates a body-sensitive vibration.

The body-sensitive vibration headphone according to the present disclosure includes an electroacoustic transducer that converts an input signal into an acoustic wave, a housing that accommodates the electroacoustic transducer, a vibrator that converts the input signal into vibration, and an ear pad attached to the housing. The vibrator is attached to the ear pad, and a structure between the vibrator and the ear pad is formed such that conduction of the vibration from the vibrator is impeded.

It is preferable to implement a structure in which the vibration of the vibrator hardly travels to the housing by using a soft foam material.

The vibrator is preferably accommodated in the ear pad or is attached to an outer surface of the ear pad.

In the body-sensitive vibration headphone according to the present disclosure, since the vibration of the vibrator hardly travels from the ear pad to the housing, occurrence of resonance in the housing due to the vibration is suppressed. In addition, since a sound hardly leaks out because of high airtightness, the sound from the electroacoustic transducer is heard clearly.

Therefore, in order to feel a bodily sensation of a sound that is felt with a body in addition to a sound that is felt with an eardrum, it is possible to implement a headphone that allows a bodily sensation of a further heavy bass sound with an impressive sound by amplifying the heavy bass sound, reproducing the signal in another unit, and feeling the reproduced sound with a body as vibration.

DESCRIPTION OF EMBODIMENT

An exemplary embodiment will be described in detail below with reference to the drawings as appropriate. However, description that is more detailed than necessary may be omitted. For example, detailed description of an already known matter and repeated description of a substantially identical configuration may be omitted. This is for avoiding the following description from becoming unnecessarily redundant and for facilitating understanding of those skilled in the art.

Note that the applicant provides the accompanying drawings and the following description to allow those skilled in the art to fully understand the present disclosure, and the accompanying drawings and the following description are not intended to limit the subject described in the claims.

Exemplary Embodiment

An exemplary embodiment will be described below with reference to FIGS. 1 to 8.

[1. Configuration]

Figure 1:
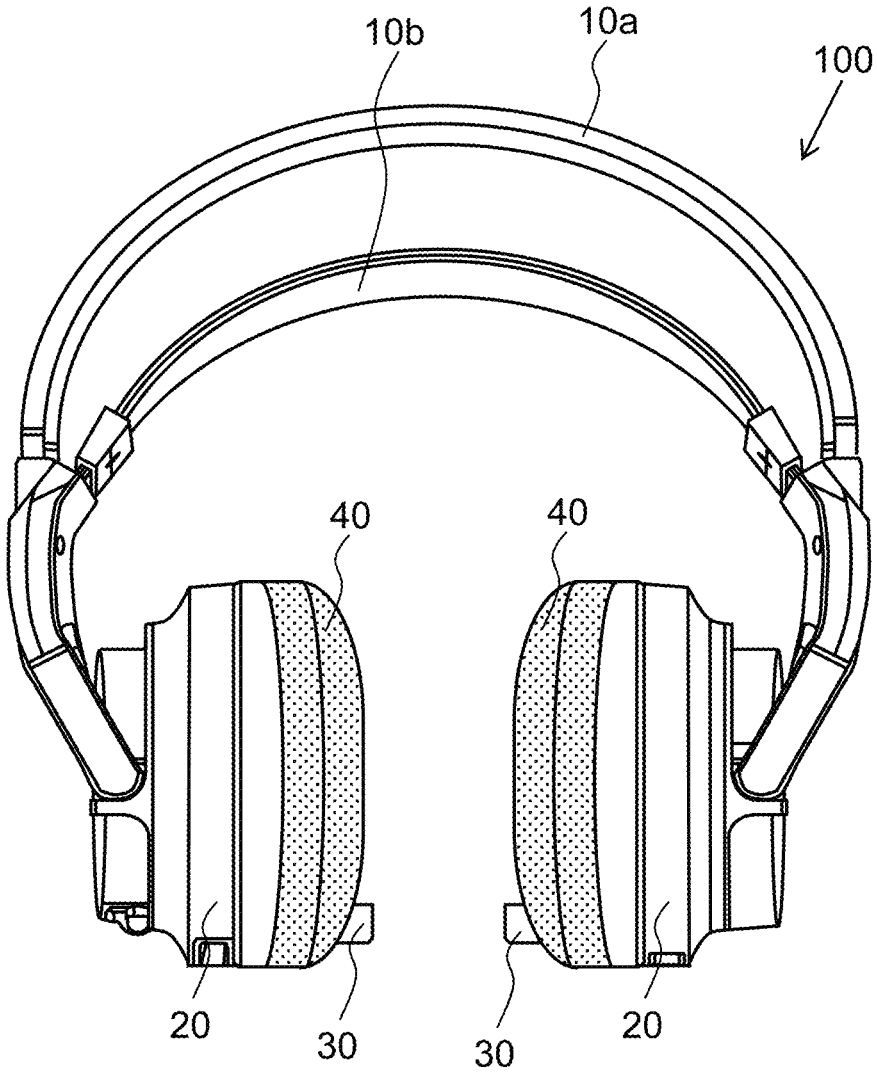
FIG. 1 is an external view of a body-sensitive vibration headphone according to an exemplary embodiment.

FIG. 1 is an external view of body-sensitive vibration headphone 100. Body-sensitive vibration headphone 100 is a high-class closed type headphone, and has higher sound insulation performance than an open type headphone. Body-sensitive vibration headphone 100 includes housing 20 that accommodates electroacoustic transducer 50 that converts an input signal into an acoustic wave described later, vibration part 30 that converts the input signal into vibration, and head band 10*a*, head band 10*b* and ear pad 40 which are attached to housing 20. Vibration part 30 is attached to ear pad 40 so as to be placed on a neck behind an ear of a user when the headphone is worn.

Figure 3:
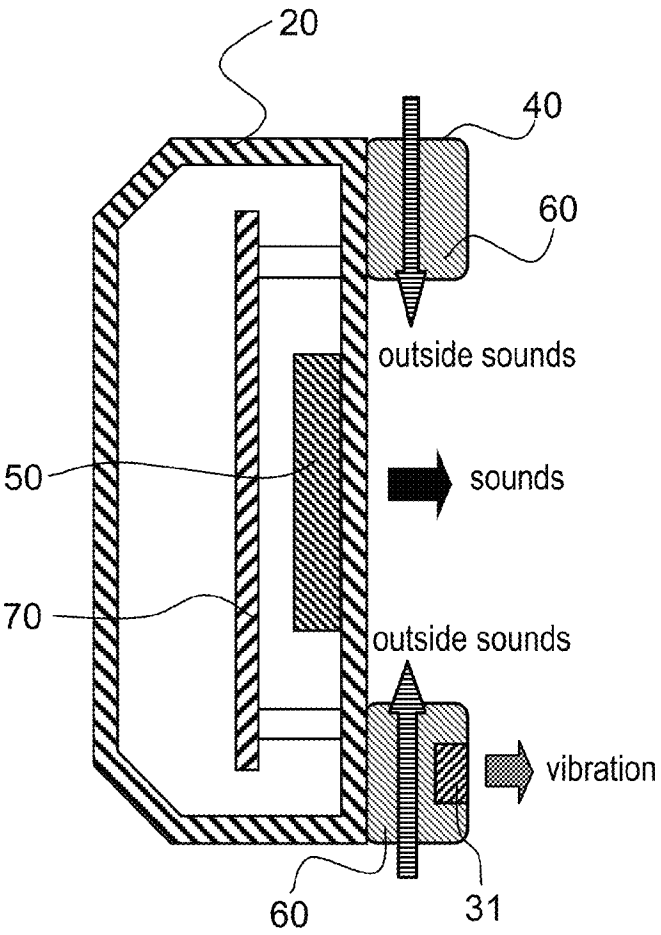
FIG. 3 is a cross-sectional view illustrating another configuration of the body-sensitive vibration headphone for describing the problem.
Figure 2:
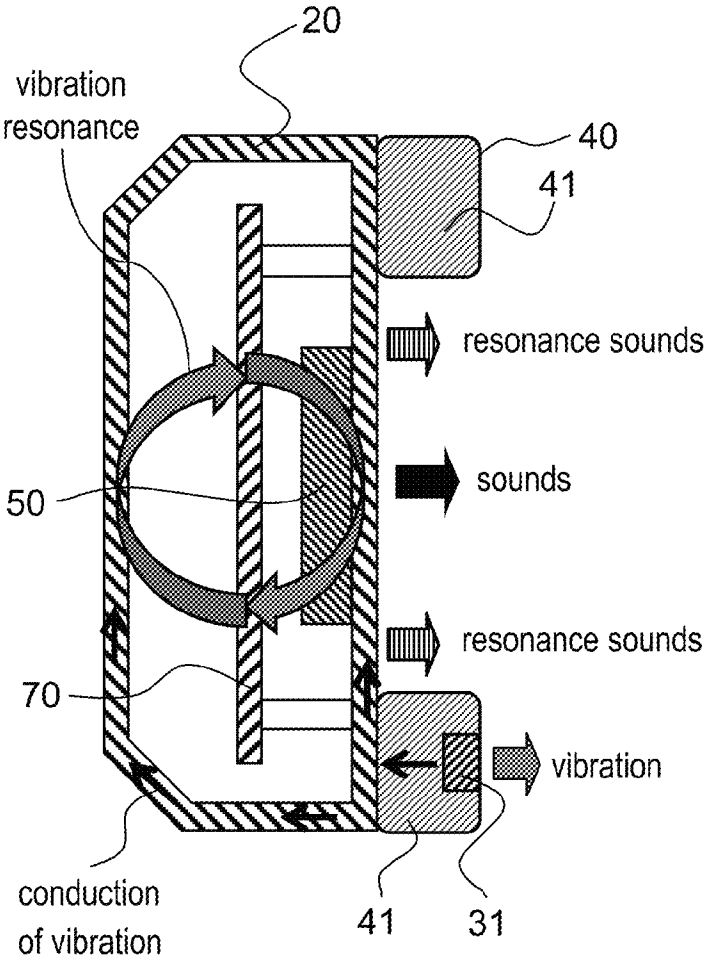
FIG. 2 is a cross-sectional view illustrating one configuration of the body-sensitive vibration headphone for describing a problem.

First, a problem to be solved by body-sensitive vibration headphone 100 according to the exemplary embodiment will be described with reference to FIG. 2 and FIG. 3. FIG. 2 is an essential part cross-sectional view illustrating a configuration of the body-sensitive vibration headphone for describing the problem. FIG. 3 is an essential part cross-sectional view illustrating another configuration of the body-sensitive vibration headphone for describing the problem.

As illustrated in FIG. 2, when vibrator 31 is simply attached so as to be accommodated in ear pad 40, ear pad 40 vibrates due to vibration of vibrator 31, and vibration of ear pad 40 travels to housing 20, and resonance occurs inside housing 20. This causes a problem that a sound is generated due to aerial vibration and is mixed with an original sound from electroacoustic transducer 50, and that reproduction of a sound with high fidelity is difficult.

In order to solve this problem, as illustrated in FIG. 3, forming ear pad 40 with a soft material such as soft urethane foam 60 can be considered so as to inhibit the vibration of vibrator 31 from traveling to housing 20. In this structure, however, since soft urethane foam 60 that forms ear pad 40 is soft and contains a lot of air, airtightness of ear pad 40 is poor. This causes a problem that a sound from outside enters inside the headphone and is mixed with a sound from electroacoustic transducer 50, and a problem that the sound from electroacoustic transducer 50 leaks out and a bass sound is not emphasized.

Figure 4:
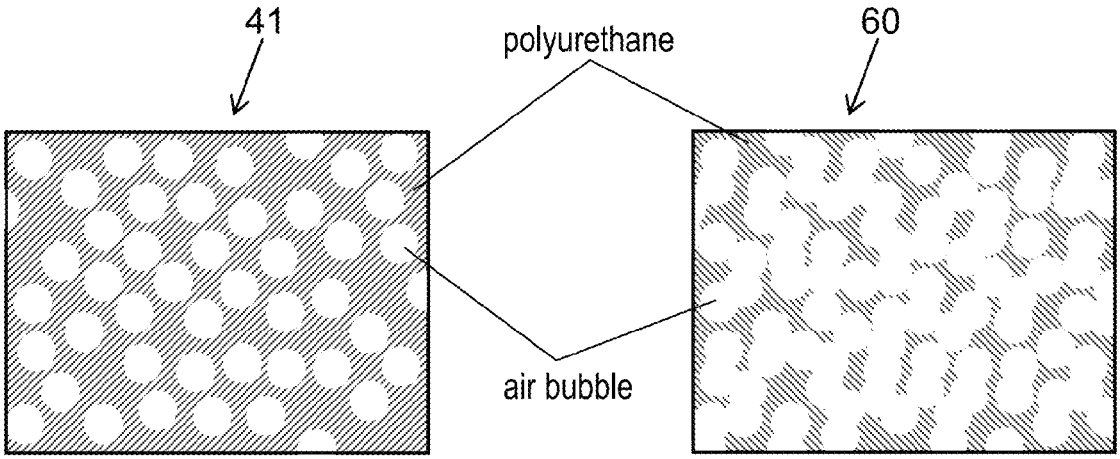
FIG. 4 is a schematic view illustrating a difference between urethane foam and soft urethane foam.

Here, a difference between urethane foam 41 and soft urethane foam 60 will be described. FIG. 4 is a schematic view illustrating the difference between urethane foam 41 and soft urethane foam 60. As illustrated in FIG. 4, both urethane foam 41 and soft urethane foam 60 have air bubbles inside polyurethane. While air bubbles in urethane foam 41 are closed cells that substantially exist independently, air bubbles in soft urethane foam 60 are open cells in which air bubbles substantially continue. Since air bubbles continue, soft urethane foam 60 has a structure that allows a sound to leak easily. A density of urethane foam 41 is about 40 kg/m$^3$, whereas a density of soft urethane foam 60 is about 20 kg/m$^3$. Thus, soft urethane foam 60, which has the small density as compared with urethane foam 41, has a property that inhibits vibration from traveling. In the present disclosure, a foam material substantially formed of closed cells is simply referred to as a foam material, whereas a foam material in which air bubbles substantially continue is particularly referred to as a soft foam material.

Conventionally, for example, urethane foam 41 is used for ear pad 40 as a material with high airtightness. Accordingly, a sound from outside hardly enters but airtightness is high, and thus ear pad 40 tends to allow vibration to travel. Body-sensitive vibration headphone 100 according to the exemplary embodiment therefore has a structure, between vibrator 31 and housing 20, is formed such that conduction of the vibration of from vibrator 31 to housing 20 only in a portion in which vibrator 31 is attached to ear pad 40 is impeded.

Figure 5:
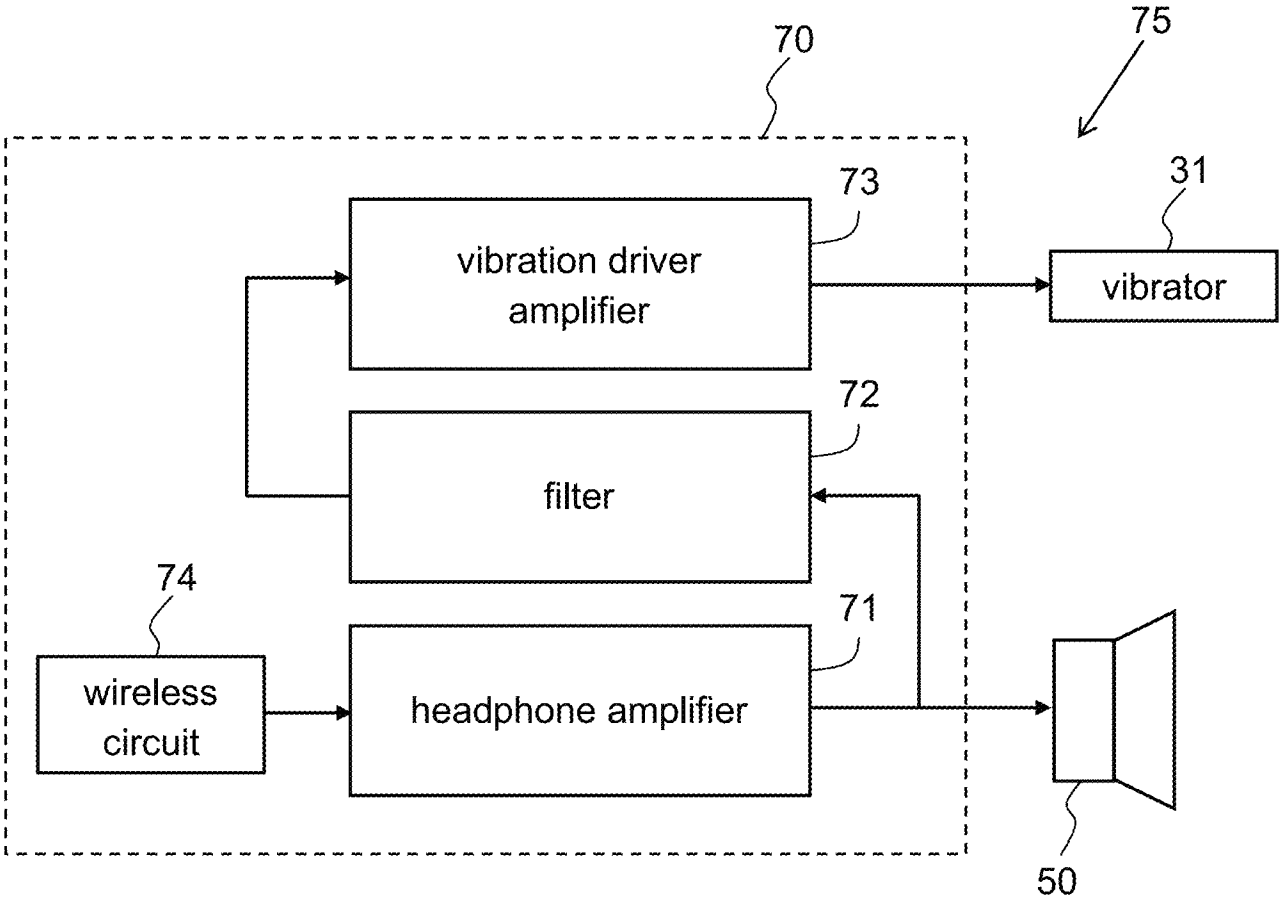
FIG. 5 is an electric circuit block diagram of the body-sensitive vibration headphone according to the exemplary embodiment.

FIG. 5 is an electric circuit block diagram of body-sensitive vibration headphone 100. Electric circuit 75 is an electric circuit for extracting an audio signal from a headphone output of a music appliance, such as a tablet terminal, a smart phone, a DVD player, and a television, and for listening to audio, such as music, a game, and a movie, in an impressive heavy bass sound. Electric circuit 75 includes circuit board 70, electroacoustic transducer 50, and vibrator 31. Circuit board 70 is mounted with headphone amplifier 71, filter 72, vibration driver amplifier 73, and wireless circuit 74.

The audio signal from a tablet terminal or the like is received by wireless circuit 74 and is input into headphone amplifier 71. The input audio signal is amplified by headphone amplifier 71, and audio is reproduced by electroacoustic transducer 50. An output signal of headphone amplifier 71 is input into filter 72, and a signal exceeding 100 Hz is removed. A signal of 100 Hz or lower having passed through filter 72 is input into and amplified by vibration driver amplifier 73, and is input into vibrator 31. Thus, when the audio signal of a heavy bass sound of 100 Hz or lower is input into body-sensitive vibration headphone 100, vibrator 31 vibrates. A user can feel a bodily sensation of the vibration generated by vibrator along with the audio reproduced by electroacoustic transducer 50 at the same time, and can feel a bodily sensation of an impressive sound.

Note that, in the present exemplary embodiment, although wireless circuit 74 is mounted in electric circuit 75 to receive the audio signal, the audio signal may be directly input into headphone amplifier with an input cord without using wireless circuit 74.

Next, two implementation examples of body-sensitive vibration headphone 100 according to the present exemplary embodiment will be described.

Figure 6:
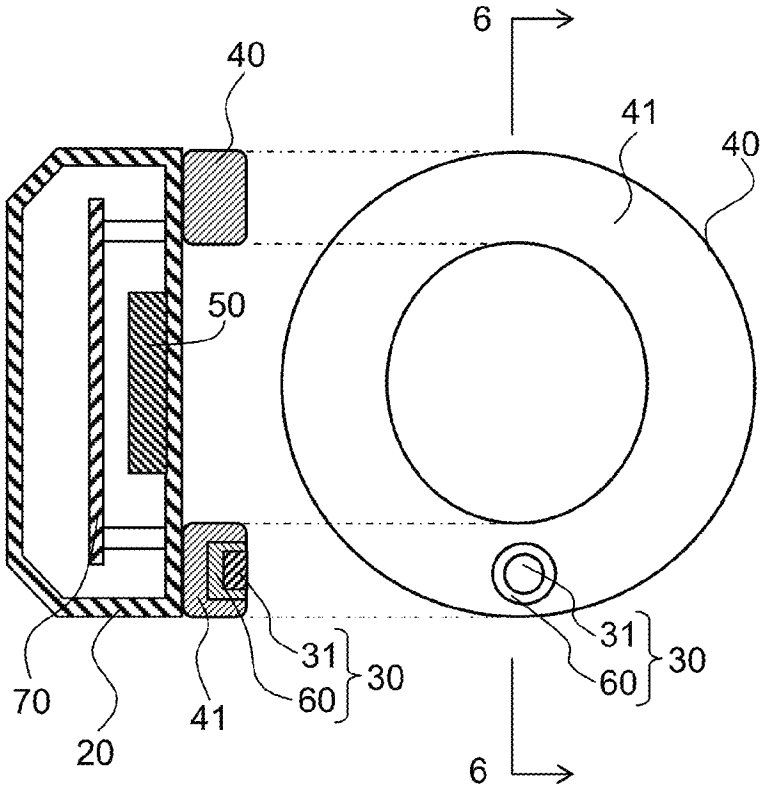
FIG. 6 illustrates an essential part front view and a cross-sectional view taken along line 6-6 in one implementation example of the body-sensitive vibration headphone.

FIG. 6 illustrates an essential part front view and a cross-sectional view taken along line 6-6 in one implementation example of body-sensitive vibration headphone. As illustrated in FIG. 6, vibrator 31 and soft urethane foam 60 are embedded so as to be accommodated in urethane foam 41 that forms ear pad 40. Vibrator 31 has a cylindrical shape, and has a top surface and bottom surface that face each other, and a side surface that connects the top surface and the bottom surface. In the present exemplary embodiment, a surface disposed on a user side is referred to as the top surface, and a surface disposed on a housing 20 side is referred to as the bottom surface. The side surface and the bottom surface of vibrator 31 are covered by soft urethane foam 60, and vibrator 31 does not contact urethane foam 41. That is, soft urethane foam 60 is interposed between vibrator 31 and urethane foam 41 of ear pad 40. Accordingly, mechanical vibration that occurs in vibrator 31 hardly travels to urethane foam 41 of ear pad 40, and further hardly travels to housing 20. In addition, soft urethane foam 60 forms a cylindrical shape as a whole while accommodating vibrator 31 therein. Here, a diameter of vibrator 31 having a cylindrical shape is about 16 mm, and its thickness is about 5 mm. A diameter of soft urethane foam 60 is about 20 mm, and its thickness is about 7 mm.

The top surface of vibrator 31 makes contact with a neck behind an ear of the user, and the vibration directly travels to a body of the user.

Figure 7:
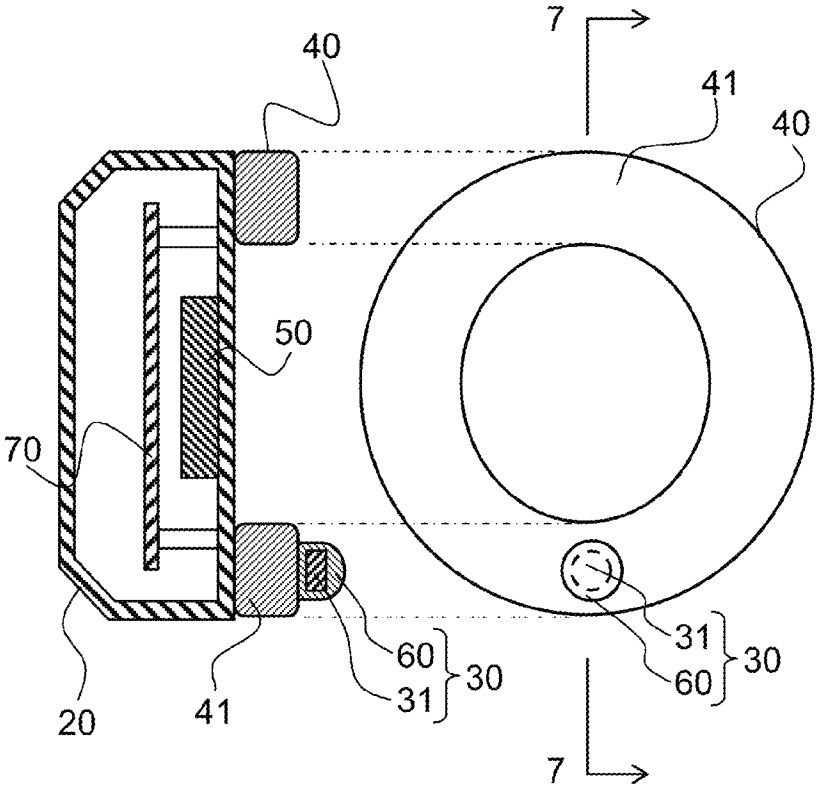
FIG. 7 illustrates an essential part front view and a cross-sectional view taken along line 7-7 in another implementation example of the body-sensitive vibration headphone.

Next, another implementation example will be described. FIG. 7 illustrates an essential part front view and a cross-sectional view taken along line 7-7 in the other implementation example of body-sensitive vibration headphone.

As illustrated in FIG. 7, vibrator 31 has a cylindrical shape and is attached to an outer surface of ear pad 40 while covered by soft urethane foam 60. Vibrator 31, which has a periphery covered by soft urethane foam 60, does not directly contact urethane foam 41 that forms ear pad 40. That is, soft urethane foam 60 is interposed between the bottom surface of vibrator 31 and urethane foam 41, and the mechanical vibration that occurs in vibrator 31 hardly travels to ear pad 40, and further hardly travels to housing 20.

Soft urethane foam 60 illustrated in FIG. 7, which also covers the top surface of vibrator 31, has a shape where a top surface of the cylindrical shape rises to a user side. Here, a diameter of vibrator 31 having a cylindrical shape is about 16 mm, and its thickness is about 5 mm. A diameter of soft urethane foam 60 is about 20 mm, and its thickness is about 10 mm.

Note that, in FIG. 7, while an entire periphery of vibrator 31 is covered by soft urethane foam 60, as in the implementation example illustrated in FIG. 6, the top surface of vibrator 31 may be exposed from soft urethane foam 60. Alternatively, the bottom surface of vibrator 31 may be covered with soft urethane foam 60, and the top surface and the side surface may be exposed. That is, when soft urethane foam 60 is interposed between vibrator 31 and urethane foam 41, and when vibrator 31 does not directly contact urethane foam 41, the vibration of vibrator 31 hardly travels to urethane foam 41 and housing 20.

[2. Operation]

Figure 8:
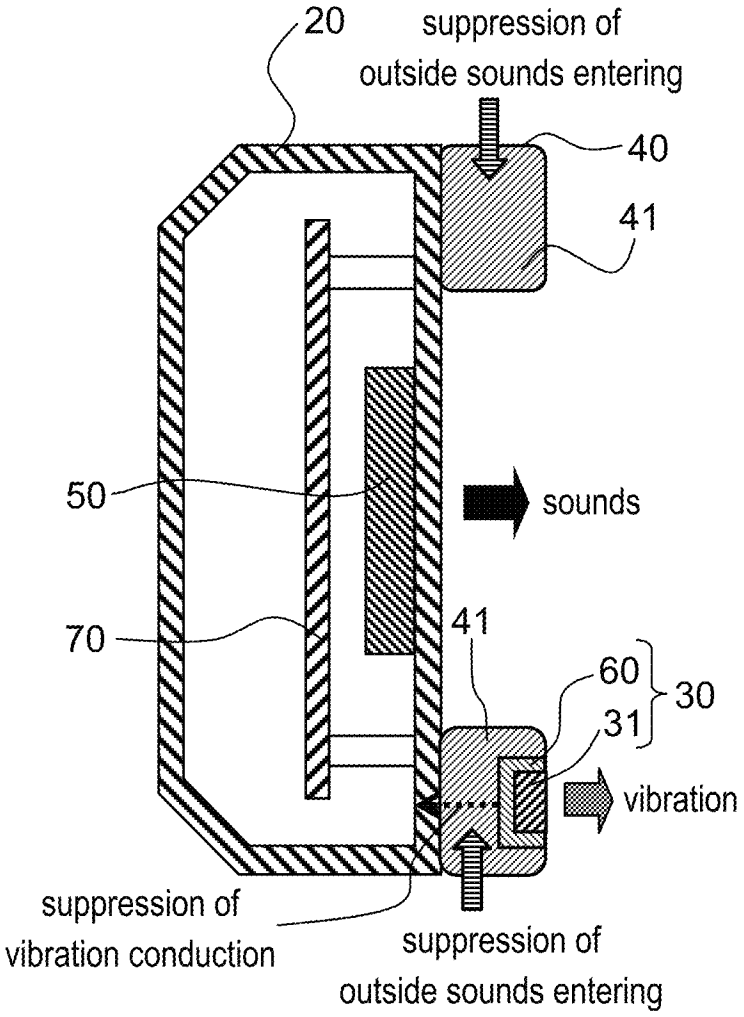
FIG. 8 is an explanatory diagram of an operation of the body-sensitive vibration headphone according to the exemplary embodiment.

FIG. 8 is an explanatory diagram of an operation of body-sensitive vibration headphone. The side surface and the bottom surface of vibrator 31 are covered by soft urethane foam 60, and vibrator 31 does not contact urethane foam 41 that forms ear pad 40. That is, by interposing soft urethane foam 60 between vibrator 31 and urethane foam 41 that forms ear pad 40, the mechanical vibration that occurs in vibrator 31 hardly travels to housing 20. This suppresses vibration resonance inside housing 20 that occurs when the vibration of vibrator 31 travels to housing 20, and suppresses mixture with a sound generated by the resonance and a sound from electroacoustic transducer 50.

In addition, even when soft urethane foam 60 is installed in ear pad 40, urethane foam 41 that forms ear pad 40 is not divided by installed soft urethane foam 60. For this reason, blockage of outside sounds by urethane foam 41 is maintained, and a sound from electroacoustic transducer 50 can be heard clearly.

[3. Summary]

As illustrated in FIG. 5, vibration driver amplifier 73 amplifies the output signal of headphone amplifier 71 which is 100 Hz or lower and extracted through filter 72, and outputs the amplified output signal to vibrator 31. Vibrator 31 vibrates when a signal of a bass sound from 50 Hz to 100 Hz inclusive is input. Since vibrator 31 vibrates in synchronization with a sound which the user is listening to, and a sound and vibration travel to a brain at an identical timing, the user can feel a bodily sensation of a heavy bass sound as compared with a case of listening to only a sound from electroacoustic transducer 50. Vibrator 31 has the top surface in contact with a neck behind an ear of a body and has a structure that allows the vibration to travel directly. Therefore, it is possible to listen to a sound with an eardrum, to feel vibration with a body, and to experience a bodily sensation as if the user is in a movie theater.

As described above, since the vibration of vibrator 31 hardly travels from ear pad 40 to housing 20, body-sensitive vibration headphone 100 according to the present exemplary embodiment suppresses occurrence of resonance caused by the vibration of vibrator 31 in housing 20. In addition, since high airtightness is maintained, a sound from electroacoustic transducer 50 hardly leaks out and can be heard clearly.

Therefore, there is implemented a headphone that makes it possible to feel a clear sound from electroacoustic transducer 50 with an eardrum, to amplify a signal of a heavy bass sound, to reproduce the signal in another unit, to convey the signal as vibration to a body, and to feel a bodily sensation of the heavy bass sound in an impressive sound.

INDUSTRIAL APPLICABILITY

The present disclosure relates to a body-sensitive vibration headphone. Specifically, the present disclosure is applicable to a closed type headphone or the like.

The invention claimed is:

1. A body-sensitive vibration headphone comprising:

an electroacoustic transducer that converts an input electric signal into an acoustic wave;

a housing that accommodates the electroacoustic transducer;

a vibrator that converts the input electric signal into vibration; and an ear pad attached to the housing, wherein:

the vibrator is attached to the ear pad, a structure is disposed between the vibrator and the ear pad and is formed such that conduction of the vibration from the vibrator to the ear pad is impeded, the structure includes a soft foam material having a lower density than a material constituting the ear pad, and the material constituting the ear pad is urethane foam and the soft foam material is soft urethane foam.

2. The body-sensitive vibration headphone according to claim 1, wherein the vibrator is accommodated in the ear pad.

3. The body-sensitive vibration headphone according to claim 1, wherein the vibrator is attached to an outer surface of the ear pad.

4. The body-sensitive vibration headphone according to claim 1, further comprising:

a first amplifier for the electroacoustic transducer;

a second amplifier for the vibrator; and a low pass filter, wherein the second amplifier amplifies an output of the low pass filter.

* * * * *